US005456305A

United States Patent [19]

Snarli

[11] Patent Number: 5,456,305

[45] Date of Patent: Oct. 10, 1995

[54] ROLLABLE OR FOLDABLE SHUTTER

[76] Inventor: Roger S. Snarli, Postboks 102 - KjelsÅs, N-0411 Oslo, Norway

[21] Appl. No.: 375,570

[22] Filed: Jan. 18, 1995

Related U.S. Application Data

[63] Continuation of Ser. No. 42,460, Apr. 5, 1993, abandoned, which is a continuation of Ser. No. 752,519, filed as PCT/N090/00035, Feb. 15, 1990, abandoned.

[30] Foreign Application Priority Data

| | | | |
|---|---|---|---|
| Mar. 2, 1989 | [NO] | Norway | 890902 |
| Jan. 25, 1990 | [NO] | Norway | 900355 |

[51] Int. Cl.[6] ..... E06B 9/08

[52] U.S. Cl. ..... 160/133; 160/213

[58] Field of Search ..... 160/133, 199, 160/206, 196.1, 229.1, 213

[56] References Cited

U.S. PATENT DOCUMENTS

| | | | |
|---|---|---|---|
| 1,437,205 | 11/1922 | Sheffield | 160/133 |
| 2,390,116 | 12/1945 | Michelman | 160/133 |
| 3,889,315 | 6/1975 | StoÅuffer . | |
| 3,901,302 | 8/1975 | Dagenais | 160/199 X |
| 3,941,180 | 3/1976 | Thill . | |
| 4,332,287 | 6/1982 | Stolpe | 160/229.1 X |
| 4,345,635 | 8/1982 | Solomon | 160/133 |
| 4,567,931 | 2/1986 | Wentzel . | |
| 4,736,785 | 4/1988 | Seuster | 160/229.1 X |
| 4,922,987 | 5/1990 | Marontate et al. | 160/199 X |

FOREIGN PATENT DOCUMENTS

| | | |
|---|---|---|
| 607114 | 2/1991 | Australia . |
| 154717 | 12/1988 | Denmark . |
| 2643938 | 2/1991 | France . |
| 452284 | 11/1927 | Germany . |
| 902171 U | 4/1990 | Germany . |
| 9000649 | 10/1991 | Spain . |
| 2120306 | 11/1983 | United Kingdom . |

OTHER PUBLICATIONS

Norwegian Building Construction Catalogue, vol. 10 (Norsk Byggtjeneste A.S) of Oct. 1987.

*Primary Examiner*—David M. Purol
*Attorney, Agent, or Firm*—Morgan & Finnegan

[57] ABSTRACT

A rollable or foldable shutter device for protecting, closing off or partitioning of areas, such as window areas. The shutter is provided with panels (2) made from a transparent material, such as polycarbonate, and hinges (1) which are mounted so that it can be folded or rolled up. The hinges (1) and the panels (2) may be made in one piece. When the device is used, at least a part of the transparency remains.

6 Claims, 3 Drawing Sheets

ROLLABLE OR FOLDABLE SHUTTER

This is a continuation of application Ser. No. 08/042,460, filed on Apr. 5, 1993 now abandoned, which is a continuation of application Ser. No. 07/752,519, filed as PCT/N090/00035, Feb. 15, 1990, now abandoned.

This invention relates to a device for protecting, closing or partitioning of space.

More particularly, this invention relates to a device for protecting, closing or dividing of window areas where all or parts of the device are transparent.

BACKGROUND OF THE INVENTION

According to the prior art numerous devices are known for protecting and closing of windows, doors etc. These devices are mainly constructed from steel or aluminum with open mesh, or from compact blinds made of steel or aluminum. Certain applications consist of panels with consecutive punched out areas, thereby providing open areas that look like a lattice when the panels are joined. This latter kind of application for protection is designed to be rolled up in a roll. Devices are also known for closing off areas that slide together sideways, such as folding walls and/or doors or saxon lattices.

Danish patent application 4323/84 describes a reinforcable rolling blind which consists of parallel, reinforced profiled rails wherein lattice joints are mounted so that when the lattice joints are closed they form a lattice with open spaces. This lattice is consequently not completely compact like that of the present invention.

German patent No. 452284 describes a protection lattice for windows and doors which forms a partly open lattice in a closed position.

U.S. Pat. No. 3,889,315 describes a security hinge for doors.

In the Norwegian Building Construction Catalogue vol. 10 (Norsk Byggtjeneste) there is described a panelfold consisting of chipboard elements which are hinged together by PVC hinges. The chipboard elements are provided with areas of a transparent material. This panelfold is preferably used for partitioning of rooms.

However, the various prior art constructions do not fulfill the necessary requirements of protection against a variety of new methods of burglary and vandalism. Moreover, if compact shutters are used, all of the transparency is lost.

In contrast, in a device according to present invention, the area to be protected will be completely shut off while at the same time most of the transparency is retained. The device according to the present invention can be used both as a roller shutter, which can be rolled together as a roll above the opening, or as a folding shutter which can be pushed together sideways.

THE DRAWINGS

The present invention shall now be further described with reference to the accompanying drawings, where the same numbers refer to the same parts, unless otherwise indicated.

Figure 1:
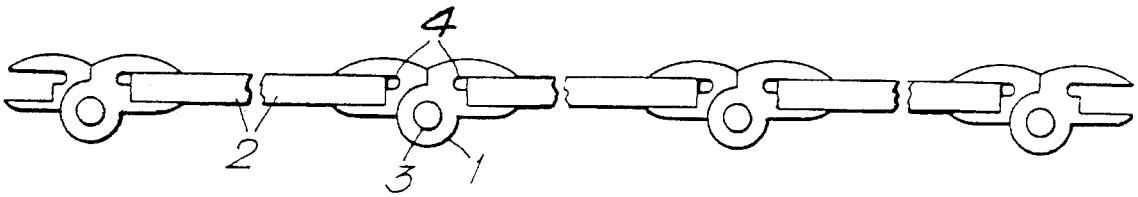
FIG. 1 shows an embodiment of the present invention where all the hinges (1) are mounted such that they all close the same way and, therefore, this embodiment can be used as a rollable shutter.
Figure 2:
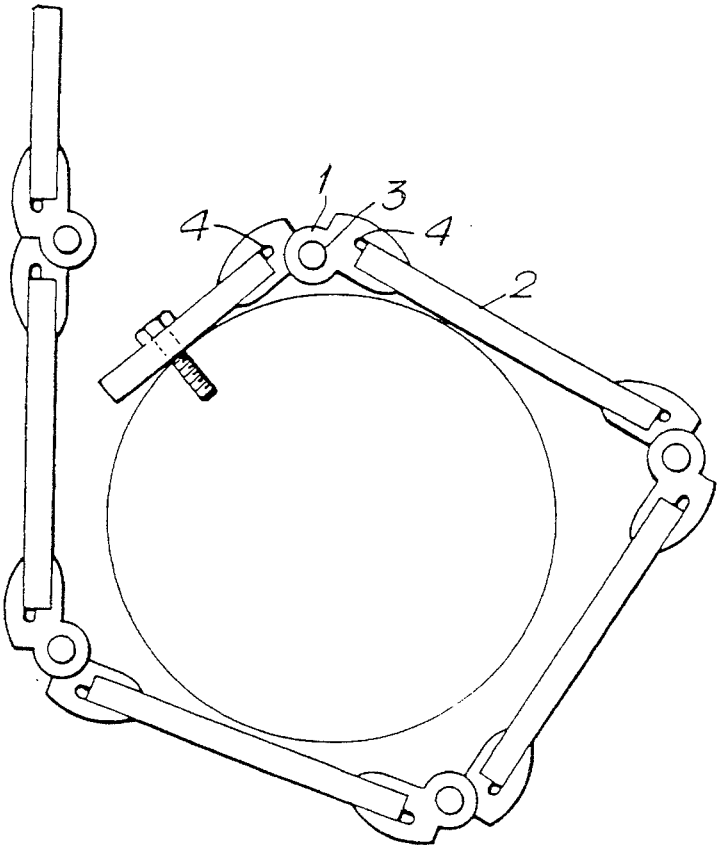
FIG. 2 shows the embodiment in FIG. 1 in a partly rolled-up position. The connected panels (2) optionally may be of different lengths, being shortest in the end that is to be rolled up first and longest in the end that is to be rolled up last, to get a roll as small as possible.
Figure 3:
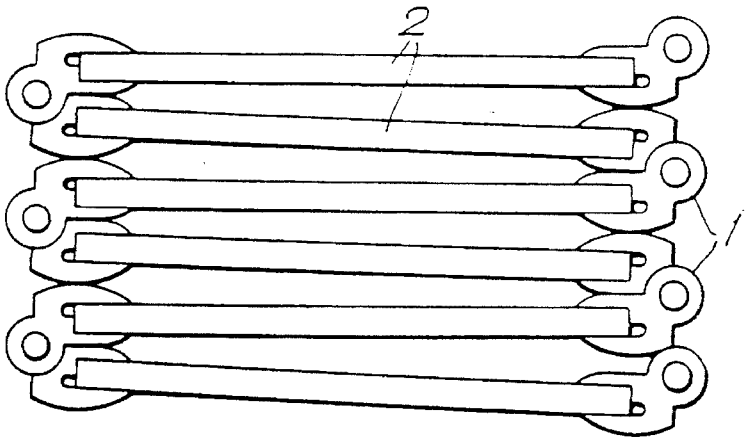
FIG. 3 shows another embodiment according to the invention where the hinges (1) close alternately in different directions and thus the device can be folded to a closed position.
Figure 4:
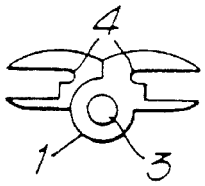

FIG. 4 is a cross-section of one embodiment of the hinge 1 with a cylindrical hole 3 therein in which a lock bolt, and a cylindrical groove 4 in which an electrical wire is disposed. The lock bolt is provided additionally at each end with a wheel (not shown) that fits into the guide rail to prevent the panel from being knocked out of the shutter.

Figure 5:
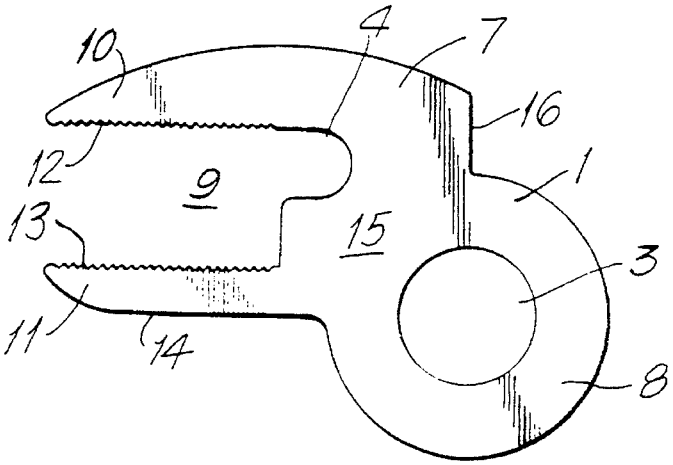

FIG. 5 shows a hinge part 6 consisting of a panel holder portion 7 and a rotation portion 8. The panel holder portion 7 comprises a substantially U-shaped securing groove 9 and a cylindrical groove 4 for an electrical wire. The securing groove 9 is surrounded by a web portion 15 and two flanks 10 and 11 with substantially parallel inner boundary surfaces 12 and 13. The spacing between the flanks is adjusted to the thickness of the plates. One flank 11 and the web portion 15 have substantially flat and orthogonal outer boundary surfaces 14 and 16. The rotation portion 8 has a cylindrical hole 3 for disposition of the lock bolt. The rotation portion 8 is segmented along the length of the hinge 1 such that the rotation portions 8 of adjacent panels 2 are interleaved as is known in conventional hinges.

Figure 6:
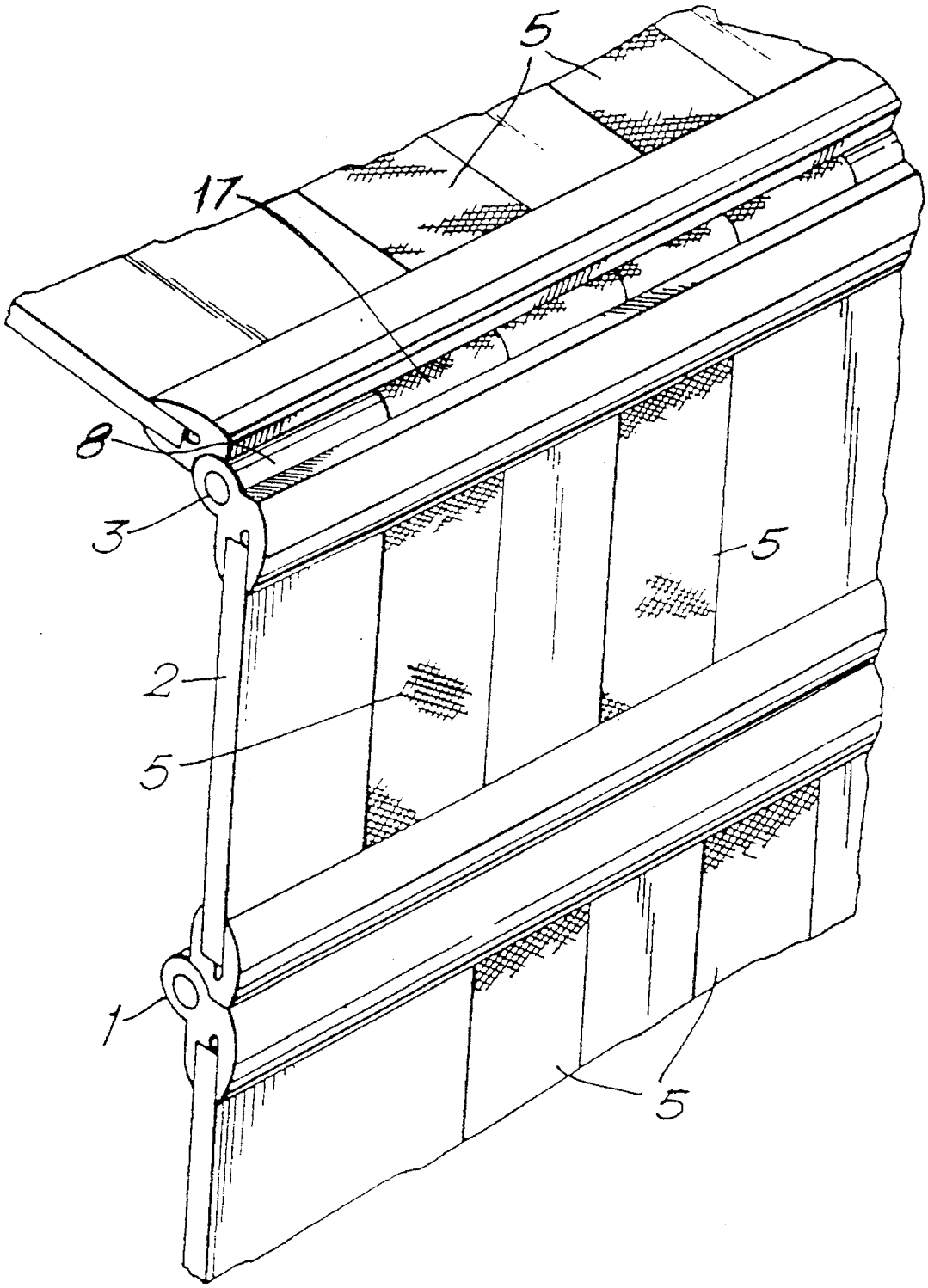

FIG. 6 shows an embodiment of the present invention where the panels 2 are provided with additional reinforcing braces 5 attached to the lock bolts for additional reinforcement of the shutter. These braces 5 can, for instance, be a strip of stainless steel with a hook 17 in each end that can be attached to the lock bolts. The hook 17 replaces the respective segmented rotation portion 8 of the hinge 1. These braces will act as a further protection and prevent the panels 2 from being knocked out of the shutter. A lock bolt disposed in the holes 3 also holds the braces 5 in place in a pivotable manner.

DESCRIPTION OF THE PREFERRED EMBODIMENTS

The device according to the present invention consists of transparent panels 2 which are mounted together by a hinge 1. Both the panels 2 and the hinges may be made in one piece. The hinges are designed with securing grooves 9 for inserting transparent panels, for instance panels made of polycarbonate, if the device consists of both panels 2 and hinges 1. The hinges are designed in such a way that when the shutter is closed, that is shut off, the core of the hinge is protected against attack and the shutter will be more rigid because the hinge 1 in this position will stop further movement. The hinge can be rotated to fold up completely. By mounting the hinges alternately in different directions, a foldable shutter, which can be pushed sideways is achieved. When the hinge is in the normal position, i.e. when all the hinges turn in the same direction, the shutter operates a rollable shutter.

To protect the shutter further against burglary and vandalism, the hinges one provided with additional cylindrical grooves 4, in which an electrical wire, i.e. an isolated wire of copper, connected to an alarm (not shown), may be disposed. If the wire is cut off, the alarm will be activated and will act as a deterrent against further attack. The 15 core of each hinge 1 is provided with a cylindrical hole 3 in which a lock bolt is placed, as mentioned above.

The hinge 1 is designed so that when the hinge is in an open position (i.e. the panels 2 are at an angle of 180° with respect to each other) the core of the hinge is hidden, thus making it difficult to attack the hinge itself. The hinge thereby acts as a security hinge.

We claim:

1. A rollable or foldable shutter for protecting, closing off or partitioning of areas while maintaining visibility into the areas, the shutter having a plurality of transparent panels (2) made of a strong plastic material having a first thickness, a plurality of hinges (1) composed of pivotal, linked hinge parts (6), each hinge part consisting of a panel holder portion (7) and a rotation portion (8), the rotation portion having a cylindrical hole (3), the panel holder portion (7) having a substantially U-shaped securing groove (9) surrounded by a web portion (15) and two flanks (10, 11) with substantially parallel boundary surfaces (12, 13), the flanks being spaced from each other by said first thickness to accommodate the thickness of the panels (2) so that each panel (2) is secured in the groove (9) of a respective hinge part (6), pivotal disposition of two hinge parts (6) forming a cylindrical hole (3) in the rotation portion (8) of each of said hinge parts (6) for receiving a lock-bolt, one flank (11) and the web portion (15) of each hinge part (6) having outer boundary surfaces (14, 16) which are of substantially flat and orthogonal shape and a line formed by the intersection of extensions of said outer boundary surfaces (14, 16) forms the center axis of said cylindrical hole in said rotation portion (8), and wherein the hinge parts (6) at each end of the panels (2) have braces (5) of a strong metal material disposed therebetween, the braces (5) having a hooked portion (17) disposed over the lock bolt for preventing dislocation of the panels (2) from the hinges (1).

2. A rollable or foldable shutter according to claim 1 wherein the hinges (1) open and close in the same direction and said shutter can be rolled up.

3. A rollable or foldable shutter according to claim 1 wherein the hinges (1) alternately open and close in different directions and said shutter can be folded up.

4. A rollable or foldable shutter according to claim 1 wherein the transparent panels are made of polycarbonate.

5. A rollable or foldable shutter according to claim 1 wherein the panel holder portion (7) of the hinge part (6) has a cylindrical groove (4) in which a wire may be placed for connection to an alarm.

6. A rollable or foldable shutter for protecting, closing off or partitioning of areas while maintaining visibility into the areas, the shutter having a plurality of transparent panels (2) made of a strong plastic material having a first thickness, a plurality of hinges (1) composed of pivotal, linked hinge parts (6), each hinge part consisting of a panel holder portion (7) and a rotation portion (8), the rotation portion having a cylindrical hole (3), the panel holder portion (7) having a substantially U-shaped securing groove (9) surrounded by a web portion (15) and two flanks (10,11) with substantially parallel boundary surfaces (12,13), the flanks being spaced from each other by said first thickness to a accommodate the thickness of the panels (2) so that each panel (2) is secured in the groove (9) of a respective hinge part (6), pivotal disposition of two hinge parts (6) forming a cylindrical hole (3) in the rotation portion (8) of each of said hinge parts (6) for receiving a lock-bolt, one flank (11) and the web portion (15) of each hinge part (6) having outer boundary surfaces (14,16) which are of substantially flat and orthogonal shape and wherein a line formed by the intersection of extensions of said outer boundary surfaces (14,16) forms the center axis of said cylindrical hole in said rotation portion (8), the panel holder portion (7) of the hinge part (6) further having a cylindrical groove (4) in which a wire may be placed for connection to an alarm, and wherein the hinge parts (6) at each end of the panels (2) have braces (5) of a strong metal material disposed therebetween, the braces (5) having a hooked portion (17) disposed over the lock-bolt for preventing dislocation of the panels (2) from the hinges (1).

* * * * *